US008910642B2

(12) United States Patent
Swan

(10) Patent No.: US 8,910,642 B2
(45) Date of Patent: Dec. 16, 2014

(54) HAIR SPOON

(75) Inventor: Cathy W. Swan, Paradise Valley, AZ (US)

(73) Assignee: Cathy W. Swan, Paradise Valley, AZ (US)

( * ) Notice: Subject to any disclaimer, the term of this patent is extended or adjusted under 35 U.S.C. 154(b) by 0 days.

(21) Appl. No.: 13/068,236

(22) Filed: May 6, 2011

(65) Prior Publication Data

US 2011/0297176 A1 Dec. 8, 2011

Related U.S. Application Data

(60) Provisional application No. 61/352,765, filed on Jun. 8, 2010.

(51) Int. Cl.

| | |
|---|---|
| ***A45D 24/00*** | (2006.01) |
| ***A45D 7/00*** | (2006.01) |
| ***A45D 8/00*** | (2006.01) |
| ***A45D 8/34*** | (2006.01) |
| ***A45D 8/36*** | (2006.01) |

(52) U.S. Cl.

CPC .. *A45D 8/00* (2013.01); *A45D 8/34* (2013.01); *A45D 8/36* (2013.01); *A45D 2007/004* (2013.01); *A45D 2008/004* (2013.01)

USPC ..... 132/200; 132/273

(58) Field of Classification Search

CPC ..... A45D 2002/006; A45D 2002/007; A45D 2/02; A45D 2/12; A45D 2/125; A45D 2/18; A45D 2/127; A45D 2/14; A45D 2/146; A45D 2/20; A45D 2007/002; A45D 2007/004; A45D 8/00; A45D 8/24; A45D 8/34; A45D 8/36; A45D 2008/004

USPC ..... 132/226, 200, 210, 212, 132, 133, 135, 132/245, 246, 247, 248, 273, 275, 276, 279, 132/222, 223, 224, 240, 241; D28/32, 39, D28/41; 30/324

See application file for complete search history.

(56) References Cited

U.S. PATENT DOCUMENTS

| | | | | | |
|---|---|---|---|---|---|
| 265,390 | A | * | 10/1882 | Cosbey | 73/427 |
| 975,222 | A | * | 11/1910 | Durbyelle | 132/245 |
| 1,633,507 | A | * | 6/1927 | Adams | 132/226 |
| 2,152,673 | A | * | 4/1939 | Solomon | 132/246 |
| 2,379,807 | A | * | 7/1945 | Klein | 132/246 |
| 2,542,601 | A | * | 2/1951 | Cleef | 132/246 |
| 2,627,275 | A | * | 2/1953 | Kiviluoma | 132/246 |
| 4,498,489 | A | * | 2/1985 | Bornhauser | 132/245 |
| 4,834,118 | A | * | 5/1989 | Goeller | 132/211 |
| D312,326 | S | * | 11/1990 | Johnson | D28/35 |
| 5,303,723 | A | * | 4/1994 | Schach | 132/246 |
| 5,372,152 | A | * | 12/1994 | Dutch | 132/246 |
| 5,494,059 | A | * | 2/1996 | Barrows et al. | 132/273 |
| 5,499,638 | A | * | 3/1996 | Ripley | 132/273 |
| 5,553,631 | A | * | 9/1996 | Schach | 132/210 |

(Continued)

*Primary Examiner* — Vanitha Elgart

(57) ABSTRACT

The "Hair Spoon" is a simple curved, double-spoon shaped, device for retaining long hair near the back of the head. This enables a method and apparatus for retaining and adornment of long hair. A hair device is used to hold long hair in a fixed location. The visible surface facing away from the head may be plain or adorned with ornaments and images. Only two motions required; one continuous motion to wrap the hair and one rotation of the device to hold it in place securely and safely. The device is simple and easy to use while ensuring beauty to the beholder.

9 Claims, 4 Drawing Sheets

(56) References Cited

U.S. PATENT DOCUMENTS

Figure 1:
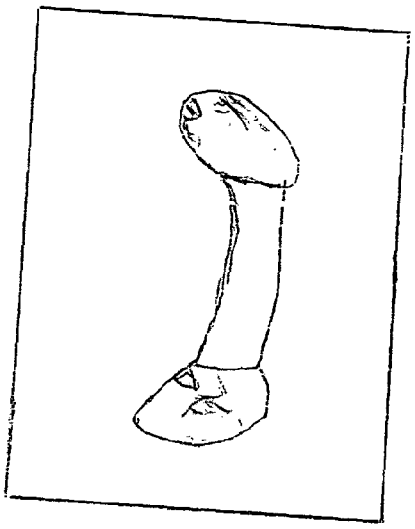

| | | | | | |
|---|---|---|---|---|---|
| 5,566,690 | A * | 10/1996 | Shih-Ming | 132/276 |
| 5,623,953 | A * | 4/1997 | McDowell | 132/210 |
| 5,664,589 | A * | 9/1997 | Black | 132/246 |
| 5,669,398 | A * | 9/1997 | Dadgostar | 132/210 |
| 5,694,955 | A * | 12/1997 | Grooms | 132/246 |
| 5,806,538 | A * | 9/1998 | Keltner | 132/210 |
| 5,964,228 | A * | 10/1999 | Chang | 132/277 |
| 5,988,183 | A * | 11/1999 | Huang | 132/273 |
| 6,115,923 | A * | 9/2000 | Gentry et al. | 30/324 |
| 6,116,251 | A * | 9/2000 | Stachowski | 132/273 |
| 6,397,854 | B1 * | 6/2002 | Bailey | 132/200 |
| D609,856 | S * | 2/2010 | Cotroneo | D28/35 |
| 8,136,534 | B2 * | 3/2012 | D'Assis et al. | 132/56 |
| 2004/0045572 | A1 * | 3/2004 | Kelsey | 132/245 |
| 2004/0226570 | A1 * | 11/2004 | De Laforcade | 132/200 |
| 2005/0229943 | A1 * | 10/2005 | Parker | 132/246 |
| 2008/0156340 | A1 * | 7/2008 | Hopper et al. | 132/275 |
| 2009/0178690 | A1 * | 7/2009 | Olson | 132/275 |
| 2010/0051044 | A1 * | 3/2010 | Pearson | 132/210 |

* cited by examiner

HAIR SPOON

CROSS-REFERENCES TO RELATED APPLICATION

This application claims benefit of U.S. Provisional Patent Application No. 61/352765, filed on Jun. 8, 2010 by Cathy Wood Swan.

Federal Sponsored R&D: None

FIELD OF INVENTION class 132 Toilet
subclass 212 Hair Devices
sub class 273 Hair Fastener
There is an additional Drawing Package for this application, attached.

BACKGROUND OF INVENTION

In 1994, in Dali China, I found a large hair device, known locally as a "beautiful nest." This awkward hair holder was to hold the hair up off the nape of the neck during extremely hot summer days. This device was not practical because of it excessive size and shape.

I developed the idea beyond the Chinese design to ensure that it would produce the proper torque to secure hair easily next to the head. This development lead to the concept of a small, attractive, practical solution looking something like two spoons attached together. Upon returning home, I have developed the idea and had many different shapes and sizes created. I have used each with my long hair and have improved the design to work especially well with extremely long hair. I have created a few items in brass and glass for testing purposes. The final design has multiple adorning images on the visible side while performing the rudimentary function of holding the hair at back of the head.

SUMMARY OF INVENTION

The Hair Spoon is a one piece device, shaped as a curved double spoon with a narrow neck, which securely holds long hair on the back of the head. It can be made of an almost infinite number of materials to include glass, metal, plastic, wood, etc. The only requirement is that it be slightly curved (to conform with the head shape) and be stiff enough to provide support for the hair and survive the torque produced when it is secured to the head. It can be produced in a number of sizes to be appropriate for the amount (thickness and length) of hair and head size. Smaller for children and shorter hair; and, larger for long thick hair on adults.

Hair spoons must be wider at each end to prevent hair from slipping off the device. It must be thin enough to slide through the hair and be able to turn around against the scalp to secure the hair.

OBJECTS AND ADVANTAGES

"It is an easy and secure way to attractively put ones hair up off the neck and shoulders."

To secure the hair to the back of the head.
To be simple with only three motions required.
To be attractive to enhance the presentation of the hair.
To be inexpensive to produce for wide distribution.
To be produced in many materials for variety and fashion.

To be produced in multiple sizes for various hair/head shapes.

DRAWING FIGURES

Figure 2:
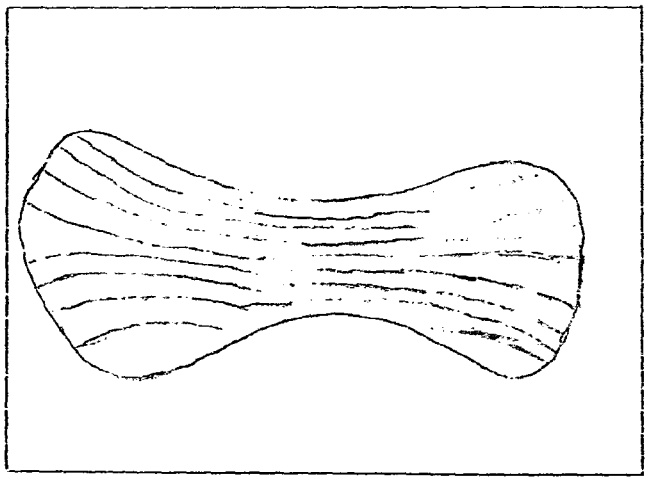
Figure 4:
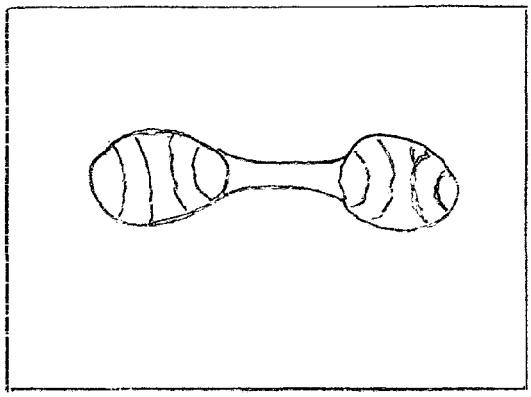
Figure 3:
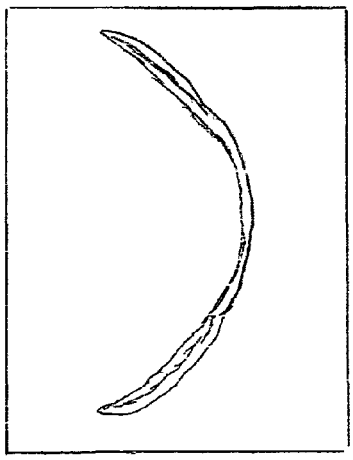
Figure 6:
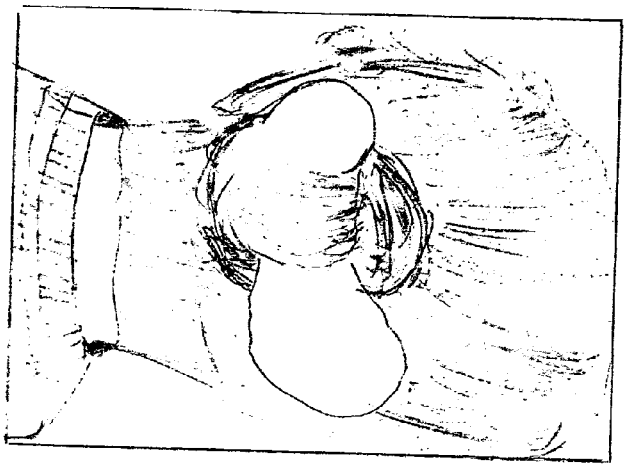
Figure 5:
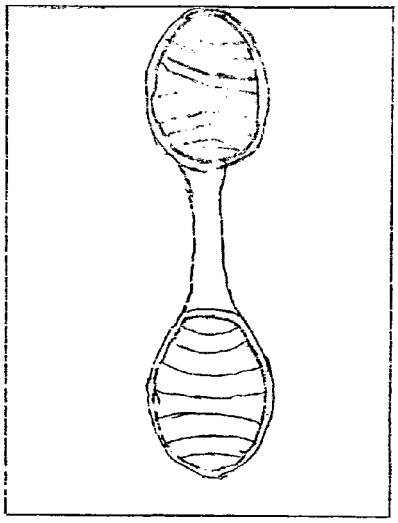
Figure 7:
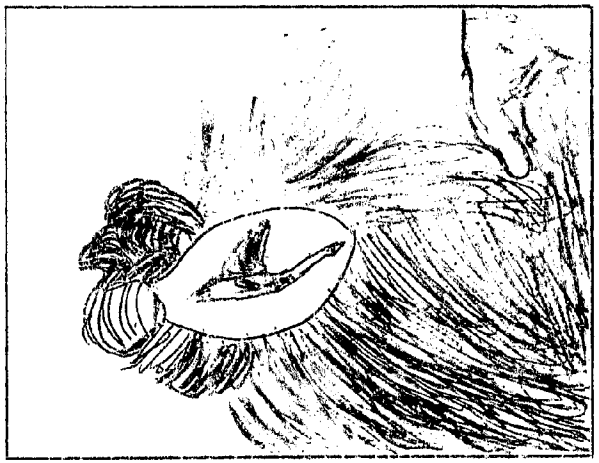

Reference Numerals to Drawing in this application package
FIG. 1, Front Page View—Basic Hair Spoon
FIG. 2, Ornamental Hair Spoon
FIG. 3, Curved Shaped
FIG. 4, Two spoon shapes
FIG. 5, Narrow Central Section
FIG. 6, Hair Spoon in Action
FIG. 7, Side View of Ornamental Hair Spoon

DETAILED DESCRIPTION OF INVENTION:

Advantages
Secures the hair to the back of the head.
Simple with only three motions required.
Attractive to enhance the presentation of the hair.
Can be inexpensive to produce for wide distribution.
Can be produced in many materials for variety and fashion.
Can be produced in multiple sizes for various hair/head shapes.

Operation

The operation of this Hair Spoon is extremely simple. To operate the device:

Step One: Create a ponytail or braid the hair into one long rope hanging down the back.
Step Two: Grasp Hair Spoon
Step three: Insert the Hair Spoon into the hair next to the scalp just above the ponytail or braid with the curve away from the head.
Step Four: Hold the Hair Spoon with one hand and wrap the hair tightly around the base of the Hair Spoon, keeping the strands tight against the head and the Hair Spoon.
Step Five: Tuck the end of the hair/braid under the wrapped hair.
Step Six: Rotate the Hair Spoon 180 degrees towards the head which is then snug against the hair wrap and the head. [thus keeping the wrap in place].

Conclusion

The Hair Spoon is a one piece device, shaped as a curved double spoon with a narrow neck, which securely holds long hair on the back of the head. It can be made of an almost infinite number of materials to include glass, metal, plastic, wood, etc. The only requirement is that it be slightly curved (to conform with the head shape) and be stiff enough to provide support for the hair and survive the torque produced when it is secured to the head. It can be produced in a number of sizes to be appropriate for the amount (thickness and length) of hair and head size. Can be smaller for children and shorter hair; while, larger for long thick hair on adults.

Hair spoons must be wider at each end to prevent hair from slipping off the device. It must be thin enough to slide through the hair and be able to turn around against the scalp to secure the hair.

"It is an easy and secure way to attractively put ones hair up off the neck and shoulders."

To secure the hair to the back of the head.
To be simple with only three motions required.
To be attractive to enhance the presentation of the hair.
To be inexpensive to produce for wide distribution.
To be produced in many materials for variety.
To be produced in multiple sizes for various hair/head shapes.

Improvements on State of Art

Secures the hair to the back of the head easily with beauty.

Simple—only three motions required.

Enhances the presentation of long hair.

Inexpensive to produce for wide distribution.

A variety of materials can be used to produce Hair Spoon.

Sizes various for hair/head shapes.

Ramification

This Hair Spoon could make it very easy for long hair to come back into vogue. The ease of use and the beauty of the various designs will enable long hair presentation in preferable styles.

Scope: Simplicity and elegant

I claim:

1. A single, one-piece, rotatable device to hold and restrain hair at the back of a person's head, the device being curved to generally conform to the curvature of the head, the device comprising a first end and an essentially identical opposing second end interconnected with a non-bendable, curved central section tapering inwardly, and the first end and the second end, respectfully, being wider than the central section each of said first and second ends including a shallow concave portion in the shape of a spoon.

2. The single device according to claim 1 further comprising the device being stiff to hold and restrain a length of hair.

3. The single device according to claim 2 further comprising the central section being tapered inwardly away from the opposing wider spoon shaped first and second ends, which are virtually identical.

4. The single device according to claim 3 further comprising a first surface adjacent to the head and a second visible surface facing away from the head.

5. The single device according to claim 4 further comprising the visible surface being plain.

6. The single device according to claim 4 further comprising the visible surface being adorned.

7. The single device according to claim 4 further comprising the visible surface being adorned with ornaments or images.

8. The single device according to claim 3 further comprising the device being constructed from a material selected from the group consisting of glass, metal, plastic and wood.

9. A method of holding and restraining long hair to the back of a person's head, using friction and torque, comprising the steps of:

a) creating a braided length of hair down from the head having a terminal end;

b) inserting a a single, one-piece, rotatable device comprising a first end and an essentially identical opposing second end interconnected with a non-bendable, curved central section tapering inwardly, each of said first and second ends being wider than said central section and including a shallow concave portion in the shape of a spoon into hair next to the head above the braided length of hair;

c) wrapping the braided length of hair tightly around the central section of the securing device inside the wider opposing first and second ends;

d) holding and restraining the terminal end of the braided length of hair under the tightly wrapped length of hair through torque, friction and tension; and e) rotating the device in its longitudinal direction 180 degrees towards the head.

* * * * *